US011031206B2

(12) United States Patent
Graves et al.

(10) Patent No.: US 11,031,206 B2
(45) Date of Patent: Jun. 8, 2021

(54) ELECTRON PHOTOINJECTOR

(71) Applicants: Arizona Board of Regents on Behalf Of Arizona State University, Scottsdale, AZ (US); TibaRay, Inc, San Jose, CA (US)

(72) Inventors: William (Bill) Graves, Tempe, AZ (US); Vinod Bharadwaj, Stanford, CA (US); Valery Dolgashev, San Carlos, CA (US)

(73) Assignees: Arizona Board of Regents on behalf of Arizona State University, Scottsdale, AZ (US); TibaRay, Inc., Sunnyvale, CA (US)

( * ) Notice: Subject to any disclaimer, the term of this patent is extended or adjusted under 35 U.S.C. 154(b) by 0 days.

(21) Appl. No.: 16/684,521

(22) Filed: Nov. 14, 2019

(65) Prior Publication Data

US 2020/0083014 A1 Mar. 12, 2020

Related U.S. Application Data

(63) Continuation of application No. PCT/US2018/032567, filed on May 14, 2018.
(Continued)

(51) Int. Cl.
*H01J 29/48* (2006.01)
*H01J 1/34* (2006.01)
*H01J 3/02* (2006.01)

(52) U.S. Cl.
CPC ..... *H01J 29/485* (2013.01); *H01J 1/34* (2013.01); *H01J 3/021* (2013.01); *H01J 29/488* (2013.01)

(58) Field of Classification Search
CPC ..... H01J 29/485; H01J 29/488; H01J 29/64; H01J 1/34; H01J 3/021
(Continued)

(56) References Cited

U.S. PATENT DOCUMENTS 6,448,722 B1 9/2002 Yu et al.
6,744,226 B2 6/2004 Yu et al.
(Continued)

FOREIGN PATENT DOCUMENTS

JP 2005-050646 A 2/2005
WO 2012177561 A2 12/2012
(Continued)

OTHER PUBLICATIONS

Alley, R et al., "The design for the LCLS rj photo-injector", 20th International Free Electron Laser and 5th Free Electron Laser Users' Workshop (Williamsburg, VA, Aug. 16-12, 1998), Jan. 1999, 12 pages.
(Continued)

*Primary Examiner* — Christopher M Raabe
(74) *Attorney, Agent, or Firm* — Morgan, Lewis & Bockius LLP

(57) ABSTRACT

A photoinjector system containing modularly-structured waveguide-mode launcher, which is reversibly connected to the RF gun (containing a tubular construction formed with disattachably-affixed to one another structurally-complementary halves); and a solenoid magnet in operation enclosing such tubular structure in a central hollow. The resulting quality, power, and frequency rate of operation as well as cost of manufacturing and operation of the system are superior as compared with those of a related art system.

8 Claims, 6 Drawing Sheets

Related U.S. Application Data

(60) Provisional application No. 62/506,382, filed on May 15, 2017.

(58) Field of Classification Search
USPC ..... 313/414
See application file for complete search history.

(56) References Cited

U.S. PATENT DOCUMENTS

| | | | | |
|---|---|---|---|---|
| 7,012,386 | B1 * | 3/2006 | Berg | H01P 1/08 315/5.41 |
| 7,310,408 | B2 | 12/2007 | Filkins et al. | |
| 7,391,850 | B2 | 6/2008 | Kaertner et al. | |
| 7,649,328 | B2 | 1/2010 | Smirnov et al. | |
| 7,786,675 | B2 * | 8/2010 | Yakovlev | H05H 7/22 315/5.39 |
| 8,581,526 | B1 | 11/2013 | Hofler | |
| 8,674,630 | B1 | 3/2014 | Cornelius | |
| 2004/0061456 | A1 | 4/2004 | Yu et al. | |
| 2008/0068110 | A1 * | 3/2008 | Smirnov | H01P 5/082 333/21 R |
| 2010/0072405 | A1 | 3/2010 | Yu et al. | |
| 2012/0229053 | A1 * | 9/2012 | Yu | H05H 9/048 315/505 |
| 2015/0285749 | A1 | 10/2015 | Moncton et al. | |
| 2016/0014876 | A1 | 1/2016 | Tantawi et al. | |
| 2019/0224751 | A1 * | 7/2019 | Thangaraj | H05H 7/22 |

FOREIGN PATENT DOCUMENTS

| | | | |
|---|---|---|---|
| WO | 2013043749 | A1 | 3/2013 |
| WO | 2020132360 | A1 | 6/2020 |
| WO | 2020150664 | A1 | 7/2020 |
| WO | 2020150665 | A1 | 7/2020 |
| WO | 2020172381 | A1 | 8/2020 |

OTHER PUBLICATIONS

Borchard, P. et al., "Fabrication of Split-Section X-band Structure Using Elastic Averaging", Proceedings of the 9th International Particle Accelerator Conference (Apr. 29-May 4, 2018, Vancouver, Canada), Jun. 2018, paper WEPMF066, pp. 2521-2524 <DOI:10.18429/JACoW-IPAC2018-WEPMF066>.

Clendenin, J., "RF Photoinjectors", International Linear Accelerator Conference (Geneva, Switzerland, Aug. 26-30, 1996), 1996, pp. 298-302.

Dal Forno, M., "Design of a high power TM01 mode launcher optimized for manufacturing by milling", SLAC National Accelerator Lab, Dec. 2016, report No. SLAC-PUB-16902, 4 pages.

England, R., "Longitudinal Shaping of Relativistic Bunches of Electrons Generated by an RF Photoinjector", University of California Los Angeles, Dissertation Doctor of Philosophy in Physics, 2007 [retrieved Aug. 15, 2020], 237 pages, retrieved from the internet: <https://www.proquest.com/docview/304875646>.

Farkhondeh, M. et al., "Design study for the RF photoinjector for the MIT-Bates X-ray laser", Proceedings of the 2003 Particle Accelerator Conference (Portland, OR, May 12-16, 2003), 2003 (Date Added to IEEE Xplore: May 4, 2004), pp. 956-958 <DOI:10.1109/PAC.2003.1289564>.

Graves, W. et al., "Compact x-ray source based on burst-mode inverse Compton scattering at 100 kHz", Physical Review Special Topics—Accelerators and Beams, Dec. 2014, vol. 17, No. 120701, 24 pages <DOI:10.1103/PhysRevSTAB.17.120701>.

Graves, W. et al., "Design of an X-Band Photoinjector Operating at 1 kHz", 8th International Particle Accelerator Conference (Copenhagen, Denmark, May 14-19, 2017), 2017, pp. 1659-1662 <DOI:10.18429/JACoW-IPAC2017-TUPAB139>.

Limborg-Deprey, C. et al., "Performance of a First Generation X-Band Photoelectron RF gun", 7th International Particle Accelerator Conference (May 8-13, 2016, Busan, South Korea), 27 slides.

Limborg-Deprey, C. et al., "Performance of a First Generation X-Band Photoelectron RF gun", Physical Review Accelerators and Beams, May 2016, vol. 19, No. 053401, 21 pages <DOI:10.1103/PhysRevAccelBeams.19.053401>.

Marsh, R. et al., "Modeling and design of an X-band rf photoinjector", Physical Review Special Topics—Accelerators and Beams, Oct. 2012, vol. 15, No. 102001, 12 pages <DOI.10.1103/PhysRevSTAB.15.102001>.

Myakishev, D. et al., "An interactive code SUPERLANS for evaluation of RF-cavities and acceleration structures", Conference Record of the 1991 IEEE Particle Accelerator Conference (May 6-9, 1991), 1991, pp. 3002-3004 <DOI:10.1109/PAC.1991.165168>.

Patent Cooperation Treaty, International Searching Authority, International Search Report for PCT/US2018/032567, 4 pages, dated Jul. 31, 2018.

Patent Cooperation Treaty, International Searching Authority, Written Opinion for PCT/US2018/032567, 8 pages, dated Jul. 31, 2018.

Rao, T. et al. (eds.), "An Engineering Guide to Photoinjectors", 2013, pp. 1-183.

Rao, T. et al. (eds.), "An Engineering Guide to Photoinjectors", 2013, pp. 184-349.

Stephan, F. et al., "High Brightness Photo Injectors for Brilliant Light Sources", Synchrotron Light Sources and Free-Electron Lasers, 2014, 38 pages <DOI:10.1007/978-3-319-04507-8_15-1>.

Xiao, L. et al., "Dual Feed RF Gun Design for the LCLS", Proceedings of the 2005 Particle Accelerator Conference (Knoxville, TN, May 16-20, 2005), 2005 (Date Added to IEEE Xplore: Feb. 16, 2006), pp. 3432-3434 DOI:10.1109/PAC.2005.1591495>.

European Patent Office, Supplemental European Search Report and Opinion for application No. 18802824.5, dated Jan. 20, 2021, 13 pages.

Moncton, D. E., et al., "Compact X-ray Sources: Addressing the limitations of Large User Facilities," Jan. 18, 2016, XP055763059, Retrieved from the Internet: URL:https://events01.synchrotron.org.au/evenV6/contributions/1437/attachments/445/619/Muncton_-_Australian_Synchrotron.pdf [retrieved on Jan. 11, 2021].

Wells, R. P., et al. "Mechanical design and fabrication of the VHF-gun, the Berkeley normal-conducting continuous-wave high-brightness electron source," *Rev. Sci. Instrum.* , AIP, Melville, NY, US, Feb. 2016;87:023302-1-023302-14.

* cited by examiner

ELECTRON PHOTOINJECTOR

CROSS-REFERENCE TO RELATED APPLICATIONS

This application is a continuation of PCT Application No. PCT/US2018/032567, filed May 14, 2018, which claims priority to U.S. Provisional Patent Application No. 62/506,382, filed May 15, 2017, each of which is herein incorporated by reference in its entirety.

TECHNICAL FIELD

The present invention relates to electron photoinjectors, which are used in advanced electron accelerators to produce an electron beam of high quality for direct use in diffraction and microscopy and for generation of powerful x-rays for scientific and medical studies.

BACKGROUND

A photoinjector is a device used to generate intense electron beams. Principal components of a radio-frequency (RF) photoinjector are an RF gun with a photocathode, a laser and optical system producing an appropriately formatted desired pulse, an RF source, and a timing and synchronization system. Photoinjectors can be used to generate high brightness electron beams for x-ray sources and particle colliders. These high brightness electron beams can be used to probe nanomaterials and the atomic and nuclear structure of matter for basic research.

Cathodes in used-to-date photoinjector systems are frequently damaged by electrical arcing and intense laser fields, necessitating removal and replacement of the cathode. The RF tuning and vacuum integrity of the photoinjector system sensitively depends on how the cathode is mounted, resulting in expensive solutions and long "down" times required to replace cathodes. Thus, there is the need for a photoinjector with an improved design that simplifies the replacement of the cathode, as well as providing an economical solution while still producing an electron beam with high efficiency (i.e., at low RF power levels).

SUMMARY

Embodiments of the invention provide a photoinjector that includes a solenoid magnet unit having a central opening; an RF gun having first and second ends and including a cathode assembly at the first end. Here, the RF gun is dimensioned to be removably inserted in said central opening to be (in one case—substantially completely) enclosed by the solenoid magnet. The embodiment additionally includes a mode launcher reversibly attachable to the RF gun at the second end to remain outside of the central opening. In one case, the solenoid magnet unit includes an iron yoke surrounding two coils that are arranged in a bucking configuration (with directions of propagation of electric currents in these coils being opposite to one another) to form, in operation, a magnetic field that is zero at a chosen location between the two coils. To this end, the RF gun is disposed such that the cathode assembly is located between the two coils at the chosen location (of the zero magnetic field) in the solenoid magnet unit.

In one case, the cathode assembly includes an RF cavity that has multiple cathode cells and is configured to generate, in operation, a standing RF wave. In any implementation, the RF gun includes a cathode cell that is shorter than a quarter-wave at the radiofrequency of operation of about 9.3 GHz. The RF gun is generally configured to include a tubular portion having an axis, which tubular portion is dimensioned to contain and include the cathode assembly, and where the tubular portion is formed by two structurally-complementary halves aligned and reversibly affixed to one another along the axis. In one implementation, the cathode assembly includes a brazed-on cathode plate; a cathode cap; and a water cooling circuit containing no joints that are exposed to a vacuum portion of the photoinjector. In a specific case, the implementation of the RF gun includes two structurally-complementing halves brazed together and aligned with a plurality of precision pins.

Embodiments further provide a method for fabricating a photoinjector. The method includes a step of reversibly joining first and second halves of an RF gun of the photoinjector (which first and second halves are structurally-complementary to one another) and a step of reversibly affixing a mode launcher unit of the photoinjector to an end of the RF gun. The method further includes inserting the RF gun into a hollow of a solenoid magnet of the photoinjector such as to have the solenoid magnet completely enclose the RF gun. The step of reversibly joining, in one case, includes aligning the first and second halves of a tubular portion of said RF gun along an axis of the tubular portion, and reversibly brazing the first and second halves to one another (here, the tubular portion contains a cathode assembly including a sequence of cathode cells disposed along the axis). The step of aligning may include aligning the first and second halves with the use of plurality of pins.

Alternatively or in addition, the method may include a step of configuring the first half (of the two structurally-complementary halves) as a half of a 9.3 GHz 4.5-cell standing-wave RF cavity; and configuring the second half to be structurally-symmetric to the first half of such cavity. The method may further contain a step of brazing on a cathode component, which component includes at least a portion of a cathode plate and/or arranging first and second solenoid coils, of the solenoid magnet unit, in a bucking configuration.

BRIEF DESCRIPTION OF THE DRAWINGS

The invention will be more fully understood by referring to the following Detailed Description of Specific Embodiments in conjunction with the not-to scale Drawings, of which.

Figure 1:
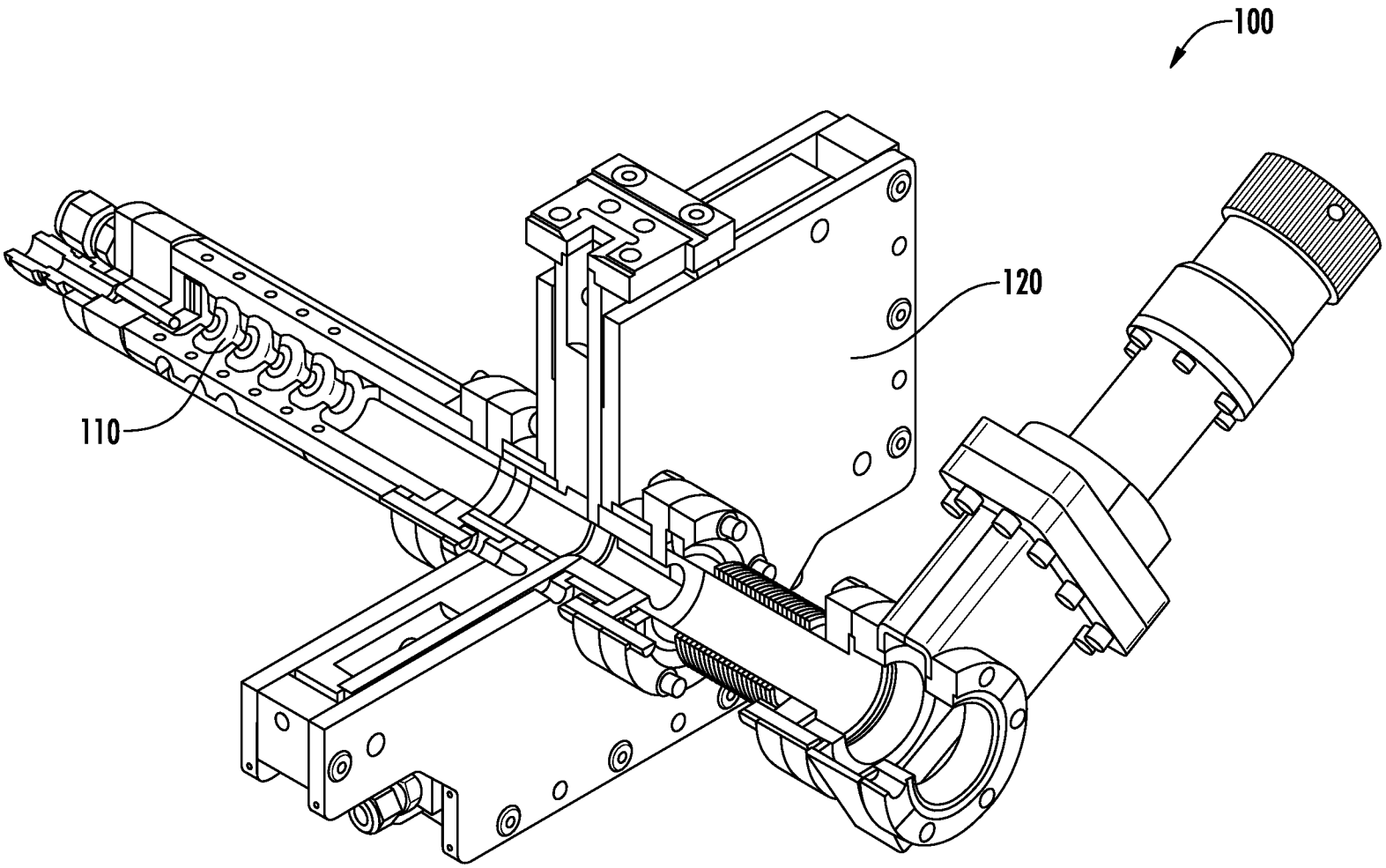
FIG. 1 shows an embodiment of a RF photoinjector that includes RF gun and mode launcher assembly, with a portion of the RF gun and mode launcher cut-away.

Generally, the sizes and relative scales of elements in Drawings may be set to be different from actual ones to appropriately facilitate simplicity, clarity, and understanding of the Drawings. For the same reason, not all elements present in one Drawing may necessarily be shown in another.

DETAILED DESCRIPTION

Embodiments of the present invention disclose methods and apparatus configured to solve the operational shortcomings of current photoinjector designs. The need for an improved design that overcomes current deficiencies in cathode replacement is satisfied with an embodiment of the photoinjector utilizing an RF gun assembly configured as a modular component to be separate and separable from the mode launcher unit of the photoinjector. Such modular RF gun assembly includes a fixed cathode in combination with a mode launcher unit. When the cathode is damaged, the entire RF gun assembly can be replaced. This modular configuration was not achievable in prior implementations of the photoinjector and is now made feasible due to the simplified structure of the photoinjector and its low cost. The simplified structure of the photoinjector is achieved, in turn, by using a modular RF mode launcher, the fixed cathode, and an overall simplification of the construction of the photoinjector. Additionally, the "down time" required to replace the photoinjector is significantly shortened when the RF gun assembly is replaced, as compared with that of related art systems.

It is well recognized in the art that a photoinjector cathode (interchangeably referred to here as a photocathode or simply cathode) is frequently damaged by electrical arcing and intense laser fields, necessitating removal and replacement of the photocathode. It is also well acknowledged that the RF tuning and vacuum integrity of the photoinjector depend sensitively on the photocathode mounting, resulting in expensive solutions and long down times for replaceable cathodes. Accordingly, with implementation of an embodiment of the present invention, in situations where the down time is not a concern, the process of repairing the photocathode of the photoinjector is substantially simplified in comparison with the process of related art. In particular, the photocathode is now replaced by removing the RF gun assembly from the solenoid of the photoinjector and re-brazing a new photocathode. The repaired RF gun is then re-inserted into the solenoid. This repair process is facilitated by the proposed design of the RF gun assembly that makes use of two structurally-complementing halves of the assembly.

A person of skill in the art will readily appreciate from the following description that embodiments of the invention possess the following structural and operational advantages over related art:

- An RF mode launcher of an embodiment is configured to couple RF power to the photoinjector axially, while removably de-coupling an RF waveguide portion from the photoinjector RF cells.
- A modular structure of the embodiment facilitates the reversible removal of the RF waveguide unit from the photoinjector. Such reversibly (dis)attachable structure facilitates and allows for a symmetric design of a solenoid magnet (for focusing an electron beam) that is now enabled to completely (entirely) enclose the photoinjector, thereby causing an improvement in electron beam quality. This is done in contradistinction with structures of related art, which have the RF waveguide unit permanently affixed directly to the photoinjector. In such related designs the solenoid magnet is mounted downstream of the photoinjector resulting in lower quality electron beams.
- According to the idea of the invention, an embodiment is using a fixed, non-replaceable photocathode, and if and when the photocathode is damaged, the entire RF gun assembly is replaced. The combination of the mode launcher and fixed photocathode greatly reduces the complexity of the photoinjector itself, making it simple and inexpensive.
- The process of manufacturing an embodiment of the photoinjector structured according to implementation(s) of the disclosed idea(s) is now reduced to fabrication of two substantially equal halves, thereby leading to improvements in the water cooling design, which enables the system of only 6" in length to operate at repetition rates up to 1 kHz. In contradistinction, designs of related art either operate at a lower repetition rate (10-120 Hz) or else are much larger in size and more expensive. Construction of the disclosed contraptions from two halves substantially reduces the cost and complexity of manufacture in comparison with the traditional method, which turns on building up cylindrically symmetric RF cavity structures and brazing together such structures as a stack (the conventionally used methods are discussed, for example, by R. A. Marsh et al., Phys. Rev. ST-AB 15 103001 (2012) or L. Xiao et al., SLAC-PUB-11213, May 2005).
- Furthermore, RF cells of the photoinjector are now configured and dimensioned to be ellipsoidal in shape, which substantially reduces the consumption of RF power (required to produce electron beam carrying the same amount of energy) as compared to that of related art. (The RF power required for operation of the system is considered to be the most critical cost driver for accelerators).

Figure 2:
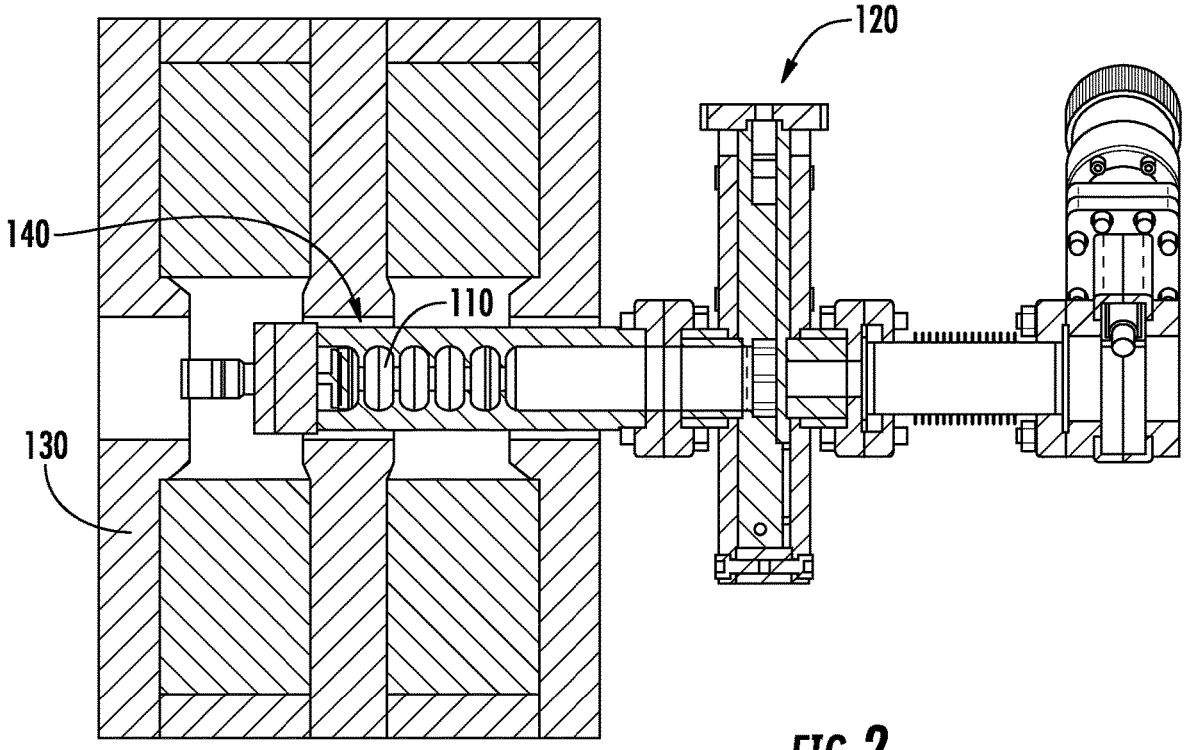
FIG. 2 shows a cross-sectional view of an RF photoinjector inserted into a solenoid.
Figure 3:
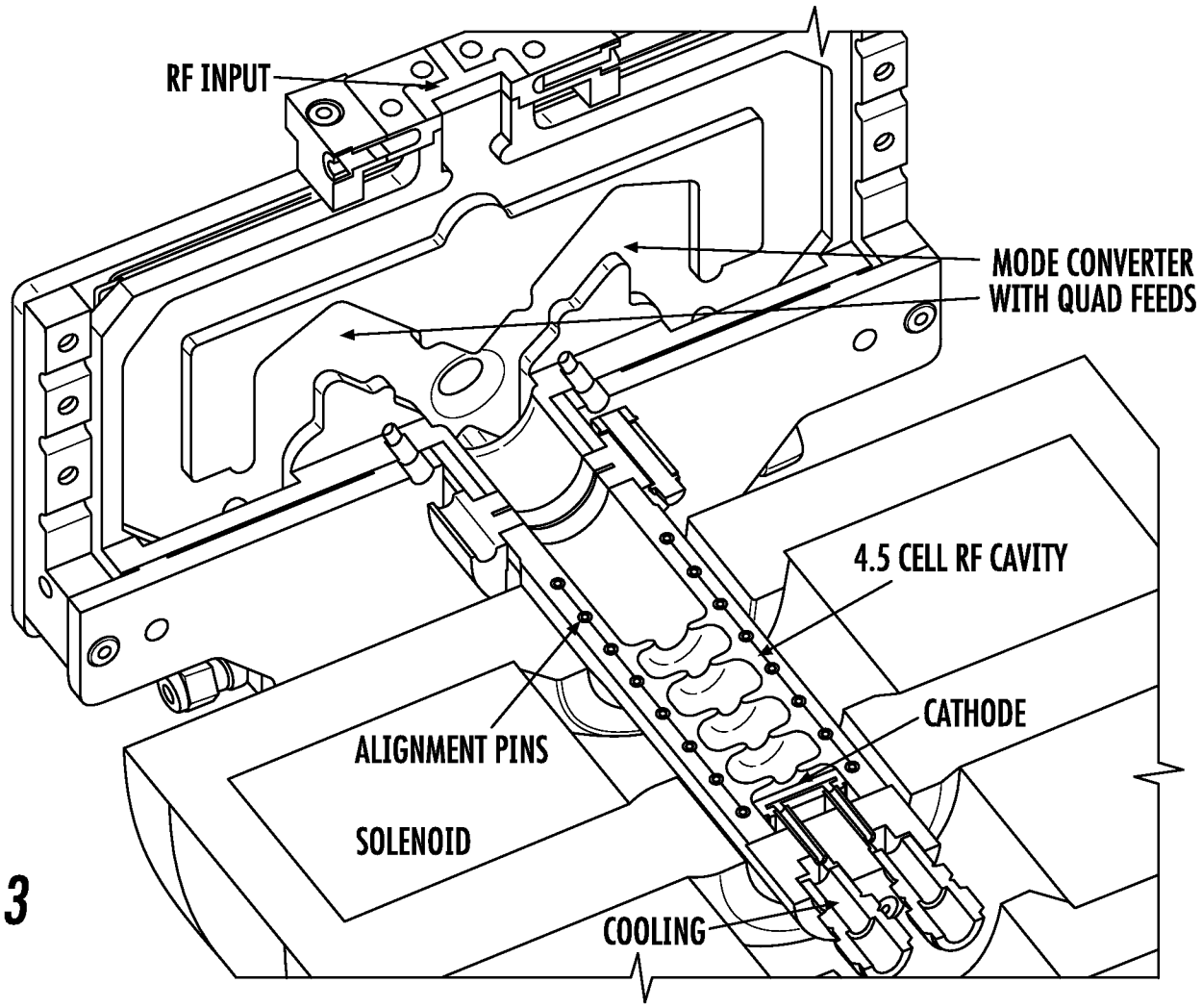
FIG. 3 shows an RF photoinjector inserted into a solenoid, with portions of the RF gun, mode launcher, and solenoid cut-away.

Referring to FIGS. 1, 2, 3, 4, 5, and 6, an embodiment of the novel RF photoinjector is now described. FIGS. 1 and 3 are cut-away views of the overall photoinjector 100 showing the RF gun assembly 140, mode launcher 120 and associated gate valve. This assembly fits into and is supported by the solenoid 130 as shown in FIGS. 2 and 3.

The embodiment 100 includes a 9.3 GHz 4.5 cell standing-wave RF cavity that is constructed from two halves. (Other operating radio-frequencies may be chosen in other embodiments.) The halves are brazed together, with the braze joint bisecting the irises and cells, greatly simplifying its construction. The cathode 110 is brazed onto this assembly. RF power is coupled into the cavity through an inline circular waveguide with the use of a TM01 mode launcher. The mode launcher 120 feeds the power through four ports to eliminate both dipole and quadrupole field distortions. The brazed-in cathode 110 and the absence of complex power coupler result in a very inexpensive yet high-performance device. The clean design allows the RF cavity to sit entirely within the solenoid assembly 130. The cathode gradient is 120 MV/m at 3 MW of input power. The length of the cathode cell is just 0.17 of the wavelength at the radiofrequency of interest, so that laser arrival phase for peak acceleration is 70 degrees from zero crossing, thereby resulting in exit energy of about 4 MeV. The embodiment 100 photoinjector operates with about 1 μs long pulses at about 1 kHz, dissipating approximately 3 kW of heat.

The major parts of the photoinjector 100 are an RF gun 140 includes a four-and-a-half-cell cavity operating at about 9.3 GHz; a mode launcher 120 waveguide assembly that matches the RF source to the gun; and a solenoid magnet unit 30 into which the RF gun is fully inserted. IN one implementation, the solenoid magnet unit 30 includes an iron yoke that surrounds first and second coils, which coils are configured as bucking coils (having different directions of winding to have a substantially zero magnetic field at the location between the first and second coils, in operation of the system). The RF gun photocathode 110 is brazed to the RF cells with substantially no provision for replacement or tuning. In this scheme, the photocathode 110 can be replaced by removing the RF gun assembly 140 from the solenoid 130 and re-brazing a new photocathode. The so-repaired RF gun 140 can then be re-inserted into the solenoid 130 and, specifically, re-inserted such as to be positioned at a location between two coils arranged in a bucking configuration. When so positioned, the RF gun assembly is disposed at the location where the magnetic field (formed in operation of the solenoid) is substantially zero.

A skilled artisan will readily appreciate the uniqueness of the proposed spatial coordination between the RF gun assembly and the solenoid magnet unit of the present system, which coordination allows one to satisfy two conditions simultaneously. On the one hand, the configuration of the embodiment should provide as strong the magnetic field after the cathode, in operation, as possible in order to focus the electrons of the electron beam before they spatially spread. (The solenoid acts as a lens for the electron beam.) Second, in doing so, the second condition—that the solenoid field be near zero at the moment the electrons are born (i.e., at the cathode)—should preferably be met. The problem with having a non-zero magnetic field on the cathode is that when the electrons eventually leave that magnetic field, the spread in transverse momentum and the electron beam brightness will decrease because the value of total momentum (kinetic and field-related, aggregately) is conserved. To avoid this effect, the present embodiment is configured according to geometry where no magnetic field is present at the cathode where the electrons are born. As a result, after being emitted, the electrons immediately enter the solenoid field, and then leave it, which preserves the electron beam brightness. Overall, in one embodiment it is preferred to both have the gun inserted into the solenoid (of the solenoid magnet unit) to achieve the desired "lensing" effect on the electrons, and also to create a geometry where the solenoid field is substantially zero at the cathode in order to preserve the electron beam brightness.

Figure 4:
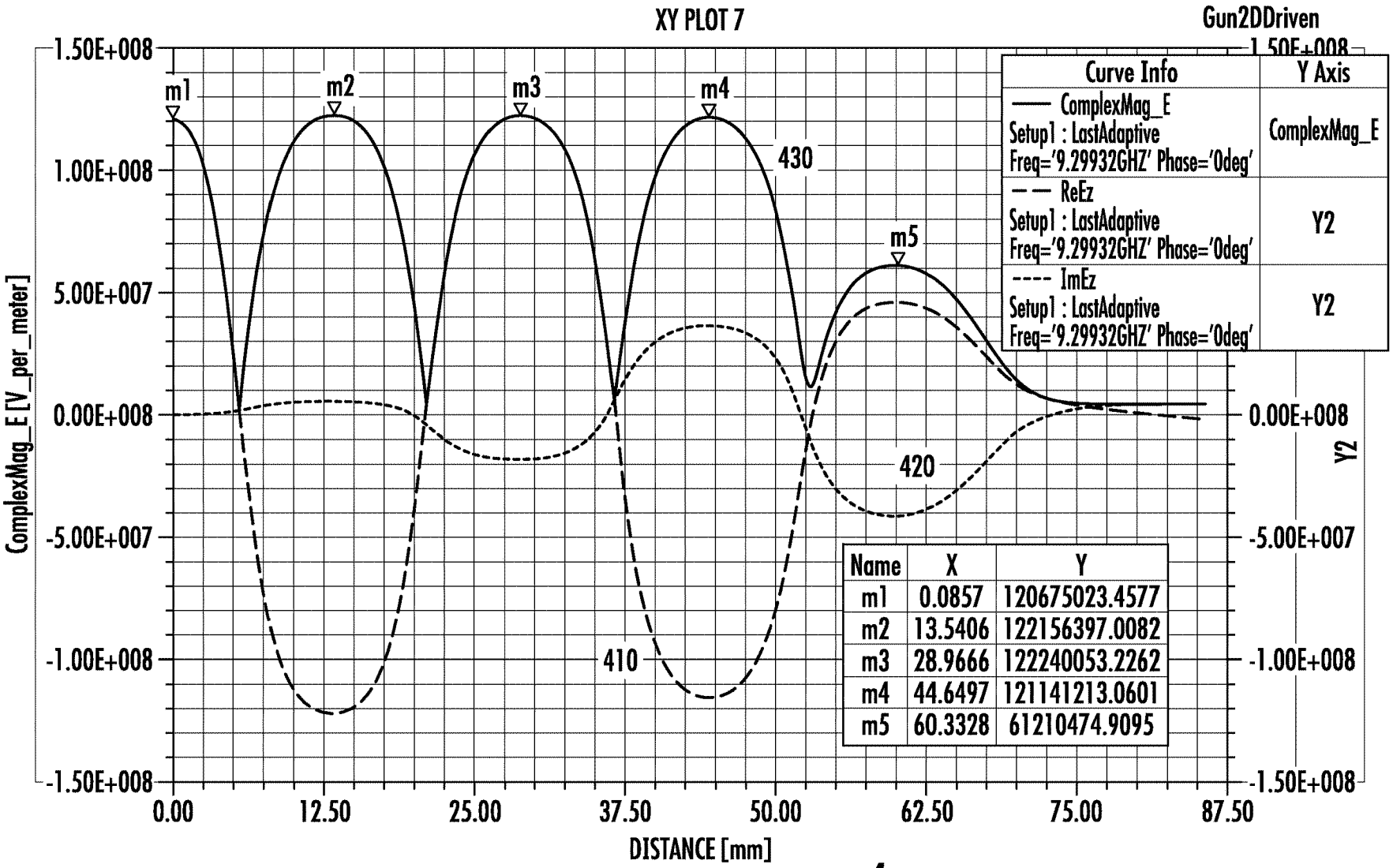
FIG. 4 shows a graph of the magnitude, real and imaginary part of electric fields with peak cathode field of 120.7 MV/m of the on-axis electric fields calculated by a driven module of HFSS simulations for 4.5 cell 9.3 GHz gun, fields normalized to 3 MW of lost RF power and RF phase is set to have only a real field on the cathode, and where the cathode is located at zero coordinate of the horizontal axis.
Figure 5:
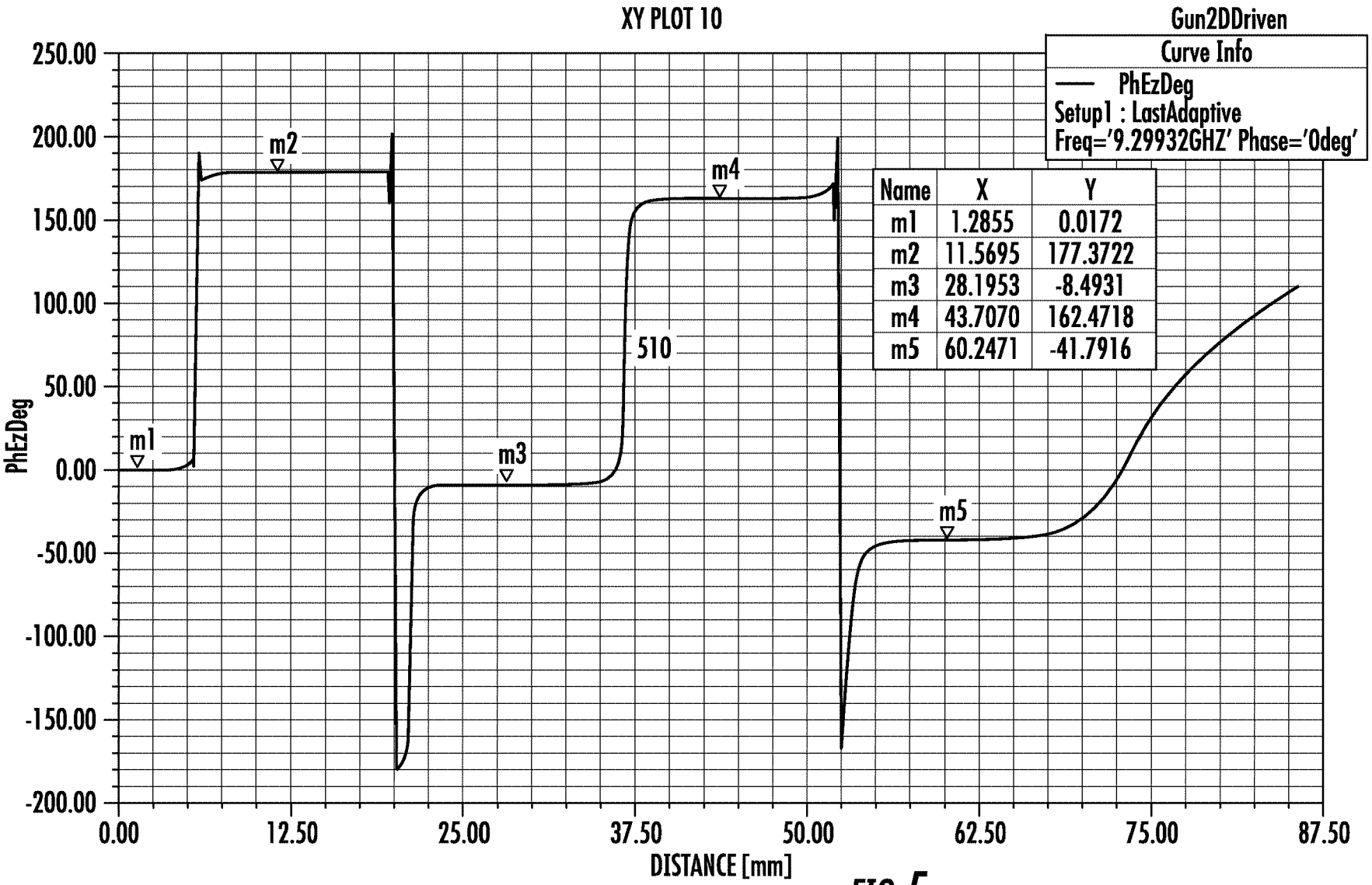
FIG. 5 shows a graph of the complex phase of the electric fields with phase slippage between coupler and the cathode cell of 42 degrees of the on-axis electric fields calculated by a driven module of HFSS simulations for 4.5 cell 9.3 GHz gun, fields normalized to 3 MW of lost RF power and RF phase is set to have only a real field on the cathode, and where the cathode is located at zero coordinate of the horizontal axis.

Below, the electrical, thermal, and mechanical design features of the embodiment 100 of the photoinjector are described. In the first step of the design process, the RF gun assembly 140 was simulated with the eigensolver of the 2D finite element code SLANS. In order to achieve high RF efficiency, the gun 140 is configured to have a relatively small aperture and thus relatively small coupling between the cells. Therefore, the calculations of the fields to be used in beam dynamics simulations were done with the driven module of HFSS. The magnitude, real and imaginary parts of complex on-axis electric field and its phase are shown in FIGS. 4 and 5 with curves 410, 420, 430, and 510. The power propagating from the gun 140 and exiting toward the photocathode 110 results in (causes) the phase shifts among the cells that must be properly accounted for in the beam dynamics simulations. The only true standing wave cavity in this design is the cathode cell. The estimate of the loaded Quality Factor (Q-loaded), defined as the ratio of the stored energy to the energy lost per radian, is 5500, which is slightly higher than the value calculated with the use of SLANS of 4562. Fill time of the cavity for Q-loaded=4562 is about 56 ns.

Practically-implemented designs were tested with the use of 2.5, 3.5, and 4.5 cells, and the 4.5 cell design proved to be preferred in practice. Such longer version of the RF gun distributes the fields over a larger area (thereby reducing thermal loading), and results in a higher beam exit energy for a given RF power. The trade-off of these operational advantages include a reduced photocathode field as compared to shorter designs. However the field of the photocathode in a 4.5 cell design of the RF gun assembly is still a robust 120 MV/m at 3 MW peak power. The photocathode "half-cell" is significantly shorter than a quarter-wave at the operations RF frequency ($\lambda_{RF}/4$) to account for a phase slip after the beam launch and to allow for cancellation of energy chirp. The length of a half-cell length was judiciously chosen to achieve maximum energy gain of 4.0 MeV for initial phase of 70 degrees from zero crossing. Maximum photocathode field could be achieved at 90 degrees, but is preferably avoided in practice in order to separate the dynamics of photocurrent from dark current that is predominantly emitted at 90 degrees.

The gun 140 is designed to operate at an unprecedented in related art high average power of about 3 kW. Given this level of output, the design of the cooling circuit may result in slightly different average temperatures in each cell. The average temperatures and distorted cavity shapes found from Ansys thermal and mechanical modeling were used to recalculate the complex on-axis electric fields for the distorted gun. After re-optimizing of the cooling channels, these results show that at full average power of 3 kW the change of the gun reflection are barely detectable in practice. The change in amplitude of the on-axis fields is a small perturbation of the real part of the complex longitudinal electric field, Re(Ez), in comparison with change of the same Re(Ez) due to the phase slippage. Increased RF field will increase RF losses and thus temperature of a cell. With increased temperature, cell frequency will drop, leading to decreased fields. This negative feedback limits the maximum dimensional distortion of the cells. Furthermore, the high power leads to azimuthally non-uniform distribution of temperatures and thus distorted cell radii. After the optimization, the distortion of the cell walls is mostly quadrupole (that is, it has 4-fold azimuthal symmetry), with the total volume being advantageously about 10 times smaller than that from a typical tuning bump, which can change cell frequency by 5 MHz. As a result, the effect of this azimuthal distortion of the cavity walls was proved to be negligibly small.

The RF gun 140 is configured and dimensioned according to the idea of structurally "splitting" the accelerator cell structure along the midplane of the structure and subsequently joining the so-divided portions using a high temperature copper-gold brazing process with the two sections aligned by precision pins 350 (see FIG. 3). The "split section" configuration substantially enhanced the flexibility of the coolant layout (as compared to a conventional axially-stacked accelerating structure of related art) and proved to result in an 80% part count reduction for such a vacuum structure with integral cooling channels in close proximity to the vacuum walls and with no vacuum to water braze joints (that is, a water cooling circuit of the RF gun contains no joints that are exposed to a vacuum portion of the photoinjector).

Figure 6:
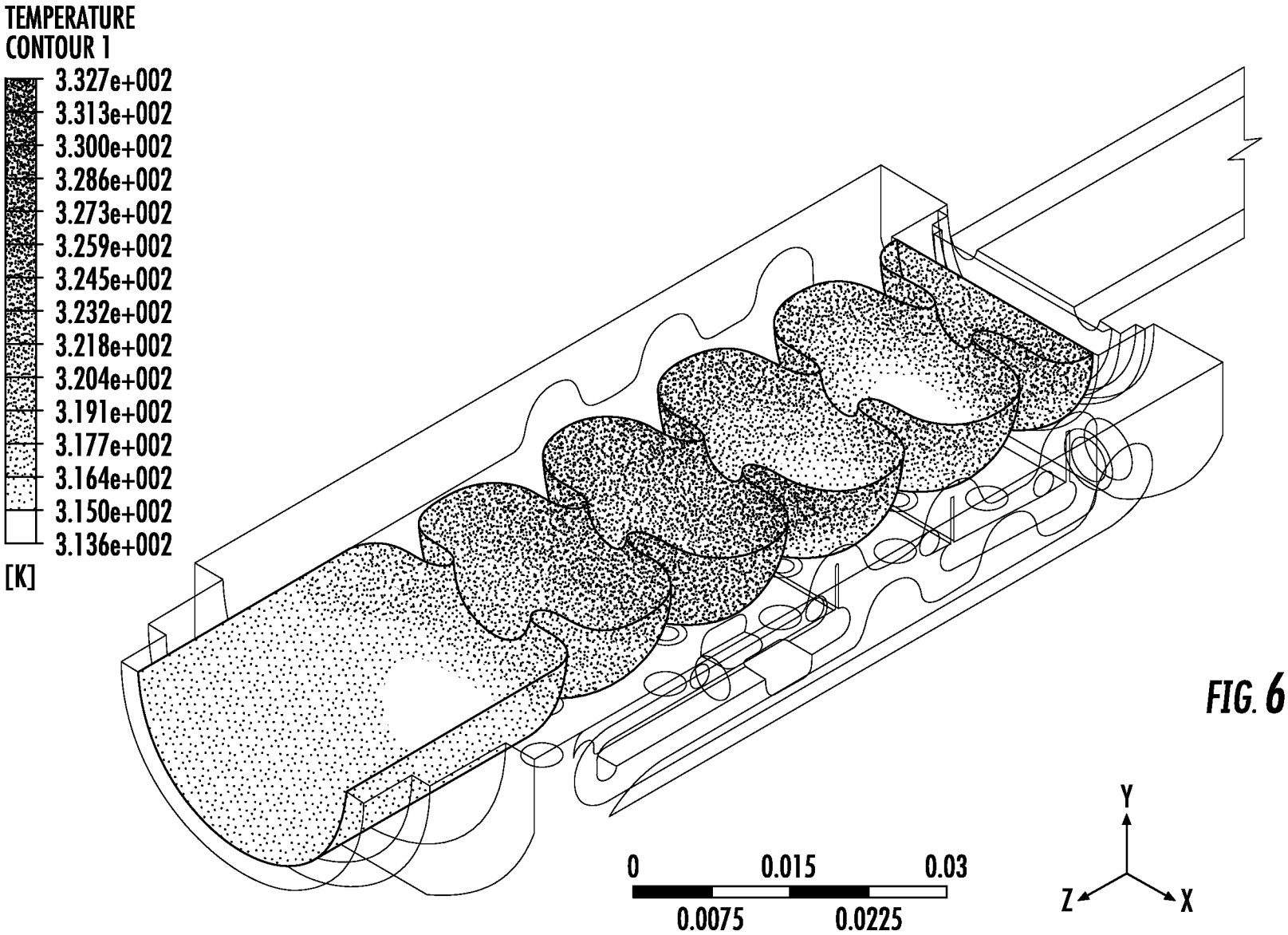
FIG. 6 is a three-dimensional representation of the temperature gradient of an RF gun structure with coolant inlet temperature of 300K.

In reference to FIG. 6, the thermal performance of the RF gun assembly 140 was further optimized using ANSYS Fluent CFD analysis. Initial CFD and ANSYS Mechanical FEA stress analysis demonstrated that additional cooling was required in the first three irises to reduce the stresses in the copper vacuum wall to below the yield strength and limit the temperature rise of the gun structure during operation. Slots were utilized in the first three irises to remove heat from the irises and reduce stresses in the copper cell walls. The structure features three separate cooling circuits to deal effectively with the 3 kW average power in a small value. In further reference to FIG. 3, the three circuits include one cathode cooling circuit 360 and one cooling circuit for each of the split halves. The coolant flow rate is 0.5 GPM in the cathode circuit and 1.5 GPM in each of the cell cooling circuits.

With an inlet temperature of 300 K and an average power loading of 3 kW, the gun structure 10 reaches a maximum temperature of 332 K, as shown in FIG. 6. Due to the optimized cooling configuration the temperature distribution across the cells remains fairly uniform with a maximum variation of approximately 15 K. The temperature rise of the cathode surface is 27 K. The temperature variations within cells are less than 8 K and the variation of average temperature between cells is below 5 K. The results of the thermal analysis were used to perform a stress analysis; the peak stress is 35 MPa which ensures that the annealed copper remains in the elastic regime. To investigate the effect of the pulse RF heating of the cell structure a 3D ANSYS thermal analysis was performed. The pulse heating is 23 K for a 3 MW 1.1 μs pulse length.

The photoinjector assembly includes the RF gun structure 10 and the mode launcher 20. In one implementation, a commercially-available gate valve is mounted to the assembly using a standard 2 and ¾ inch conflat flange and associated vacuum hardware. For the interface between the RF gun 10 and mode launcher 20, a RF vacuum flange and gasket provides a UHV joint while minimizing any effects on the RF entering the gun structure 10. The mode launcher 20 forms the main structural element; it features a stainless steel exoskeleton structure which forms a rigid backbone for the assembly.

The RF gun 10 is a brazed assembly which includes two split halves forming the cell structure which are aligned using precision alignment elements, an RF flange, a number of tuning pins and cooling covers and tubes. The cathode assembly 40 is a separate pre-brazed sub-assembly containing the cathode plate, a cathode cap to form the water cooling circuit 60 and two coolant tubes. The cell surfaces including cathode 40 have a surface finish of eight or better. In a specific case, the mode launcher 20 is a brazed assembly with a copper waveguide feed network; a WR-90 RF input flange, a ConFlat downstream vacuum flange and an upstream RF vacuum flange. The stainless steel frame plates are brazed to the copper structure in the area around the beam axis and free floating around the perimeter to minimize deformation in the structure due to the thermal expansion difference the two materials. (As known in the art, the term brazing refers to a metal joining process in which two or more metal items are joined together by melting and/or flowing a filler metal into the joint, the filler metal having a lower melting point than the adjoining metal.)

After brazing, the two facing stainless steel plates are bolted together using support blocks. The upstream and downstream beam pipes feature a copper core with an outer stainless steel sleeve for mechanical support.

A particular embodiment of the solenoid magnet 30, shown in FIGS. 2 and 3, is configured as an iron yoke surrounding two equal and opposite bucking coils that provide a B=0 plane at the magnet center. The RF gun 10 is inserted so that the cathode 40 is located at this plane. The main coils are both powered by a single power supply. A small bipolar power supply will be floated on one coil to adjust the zero field location. The field rises rapidly along the longitudinal axis to a peak value of 4900 gauss at z=5.8 cm at approximately the exit of the last RF cell. The effective magnetic length is 5.3 cm. The fast rise of the field near the cathode 40, strong B-field, and short magnetic length all contribute to a high quality lens and bright beam production. The lens captures the rapidly expanding electron beam, arresting time-dependent twists in the phase space ellipses before they show much betatron phase advance. The field strength is set to produce a beam waist of about 300 microns RMS size at 100 pC near the entrance to the first linac section. The solenoid bore has a 5.5 cm diameter to accommodate the RF gun 10. The solenoid 30 and the RF gun 10 are not physically attached so that each can be separately aligned. The solenoid mounting apparatus allows the solenoid 30 to slide backwards so that the gun 10 can be simply dismounted and replaced from its attached RF mode launcher 20. The total solenoid length is 22 cm with a diameter of 28 cm. The coil current density is 5.9 A/mm2. The solenoid design was optimized to move the lens position to the gun exit and lengthen the solenoid to reduce its geometric aberration. The solenoid power supply is sized for a factor of 50% higher current than nominal to allow operation at higher bunch charge and for solenoid emittance scans. The power supply is expected to have 10 PPM stability with DCCT feedback. At the nominal operating point, the peak flux is about 1.4 T in the main yoke and 1.6 T in the nose cones.

The structure and dimensionality of the disclosed embodiment identify, to some degree, a method for fabricating such a photoinjector, which includes the steps of (i) reversibly joining first and second halves of an RF gun of the photoinjector (here, the first and second halves are configured to be structurally-complementary to one another); (ii) reversibly affixing a mode launcher unit of the photoinjector to an end of the RF gun; and (iii) inserting the RF gun into a hollow of a solenoid magnet of the photoinjector to have the solenoid magnet completely enclose the RF gun. The process of reversibly joining the first and second halves may include the steps of aligning the first and second halves of a tubular portion of the RF gun along an axis of the tubular portion, and reversibly brazing the first and second halves to one another. Here, the tubular portion contains a cathode assembly that includes a sequence of cathode cells disposed along the axis. (In a specific case, the step of aligning includes aligning the first and second halves with the use of plurality of pins.) Alternatively or in addition, the method may include the steps of configuring the first half of the structure as a half of a 9.3 GHz 4.5-cell standing-wave RF cavity; and configuring the second half of the structure to be substantially symmetric to the first half of such cavity and/or the step of brazing on a cathode component, including at least a portion of a cathode plate.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. In one specific case, the terms "approximately", "substantially", and "about", when used in reference to a numerical value, represent a range of plus or minus 20% with respect to the specified value, more preferably plus or minus 10%, even more preferably plus or minus 5%, most preferably plus or minus 2% with respect to the specified value. As a non-limiting example, two values being "substantially equal" to one another implies that the difference between the two values may be within the range of +/−20% of the value itself, preferably within the +/−10% range of the value itself, more preferably within the range of +/−5% of the value itself, and even more preferably within the range of +/−2% or less of the value itself.

The use of these term in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated falls and may vary within a numerical range defined by an experimental measurement error that is typical when using a measurement method accepted in the art for such purposes.

For example, a reference to an identified vector or line or plane being substantially parallel to a referenced line or plane is to be construed as such a vector or line or plane that is the same as or very close to that of the referenced line or plane (with angular deviations from the referenced line or plane that are considered to be practically typical in related art, for example between zero and fifteen degrees, preferably between zero and ten degrees, more preferably between zero and 5 degrees, even more preferably between zero and 2 degrees, and most preferably between zero and 1 degree). For example, a reference to an identified vector or line or plane being substantially perpendicular to a referenced line or plane is to be construed as such a vector or line or plane the normal to the surface of which lies at or very close to the referenced line or plane (with angular deviations from the referenced line or plane that are considered to be practically typical in related art, for example between zero and fifteen degrees, preferably between zero and ten degrees, more preferably between zero and 5 degrees, even more preferably between zero and 2 degrees, and most preferably between zero and 1 degree).

Other specific examples of the meaning of the terms "substantially", "about", and/or "approximately" as applied to different practical situations may have been provided elsewhere in this disclosure.

An embodiment of the system generally may include electronic circuitry (for example, a computer processor) at least governing an operation of the embodiment and controlled by instructions stored in a memory, to perform specific data collection/processing and calculation steps as disclosed above. The memory may be random access memory (RAM), read-only memory (ROM), flash memory or any other memory, or combination thereof, suitable for storing control software or other instructions and data. Those skilled in the art should would readily appreciate that instructions or programs defining the operation of the present embodiment(s) may be delivered to a processor in many forms, including, but not limited to, information permanently stored on non-writable storage media (e.g. read-only memory devices within a computer, such as ROM, or devices readable by a computer I/O attachment, such as CD-ROM or DVD disks), information alterably stored on writable storage media (e.g. floppy disks, removable flash memory and hard drives) or information conveyed to a computer through communication media, including wired or wireless computer networks. In addition, while the invention may be embodied in software, the functions necessary to implement a method of the invention may optionally or alternatively be embodied in part or in whole using firmware and/or hardware components, such as combinatorial logic, Application Specific Integrated Circuits (ASICs), Field-Programmable Gate Arrays (FPGAs) or other hardware or some combination of hardware, software and/or firmware components.

The invention as recited in claims appended to this disclosure is intended to be assessed in light of the disclosure as a whole. Various changes in the details, steps and components that have been described may be made by those skilled in the art within the principles and scope of the invention.

While the invention is described through the above-described exemplary embodiments, it will be understood by those of ordinary skill in the art that modifications to, and variations of, the illustrated embodiments may be made without departing from the inventive concepts disclosed herein. Accordingly, the invention should not be viewed as being limited to the disclosed embodiment(s).

What is claimed is:

1. A photoinjector comprising:

a solenoid magnet unit having a central opening;

an RF gun having first and second ends and including a cathode assembly at the first end, said RF gun being dimensioned to be removably inserted in said central opening to be positioned at a chosen location at which, in operation of the photoinjector, a magnetic field is zero; and a mode launcher reversibly attachable to the RF gun at the second end to remain outside of said central opening.

2. The photoinjector according to claim 1, wherein the cathode assembly includes an RF cavity that has multiple cathode cells and is configured to generate, in operation, a standing RF wave.

3. The photoinjector according to claim 1, wherein the RF gun includes a cathode cell having a length shorter than a quarterwave at a chosen radiofrequency.

4. The photoinjector according to claim 3, wherein the chosen radiofrequency is about 9.3 GHz.

5. The photoinjector according to claim 1, wherein the RF gun is configured to include a tubular portion having an axis, said tubular portion dimensioned to contain and include the cathode assembly, said tubular portion being formed by two structurally-complementary halves aligned and reversibly affixed to one another along the axis.

6. The photoinjector according to claim 1, wherein the cathode assembly includes:

a brazed-on cathode plate;

a cathode cap; and a water cooling circuit containing no joints that are exposed to a vacuum portion of the photoinjector.

7. The photoinjector according to claim 1, wherein the RF gun includes two structurally-complementing halves brazed together and aligned with a plurality of precision pins.

8. The photoinjector according to claim 1, wherein the solenoid magnet unit includes first and second coils arranged in a bucking configuration, and an iron yoke surrounding the first and second coils, and wherein the RF gun, when inserted in the central opening, is completely enclosed by the solenoid magnet unit.

* * * * *